US006650202B2

(12) United States Patent
Rogozine et al.

(10) Patent No.: US 6,650,202 B2
(45) Date of Patent: Nov. 18, 2003

(54) CERAMIC RF FILTER HAVING IMPROVED THIRD HARMONIC RESPONSE

(75) Inventors: Alexandre Rogozine, Albuquerque, NM (US); Brian Richard Matthews, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 20 days.

(21) Appl. No.: 10/080,354

(22) Filed: Feb. 21, 2002

(65) Prior Publication Data

US 2003/0085782 A1 May 8, 2003

Related U.S. Application Data

(60) Provisional application No. 60/338,822, filed on Nov. 3, 2001.

(51) Int. Cl.[7] ..... H01P 5/12; H01P 1/202

(52) U.S. Cl. ..... 333/134; 333/206

(58) Field of Search ..... 333/202, 206, 333/207, 134, 222

(56) References Cited

U.S. PATENT DOCUMENTS

| | | | | |
|---|---|---|---|---|
| 4,431,977 A | | 2/1984 | Sokola et al. | |
| 4,673,902 A | * | 6/1987 | Takeda et al. | 333/202 |
| 4,855,693 A | * | 8/1989 | Matsukura et al. | 333/202 |
| 4,879,533 A | * | 11/1989 | de Muro et al. | 333/206 |
| 4,896,124 A | | 1/1990 | Schwent | |
| 4,954,796 A | * | 9/1990 | Green et al. | 333/206 |
| 5,004,992 A | * | 4/1991 | Grieco et al. | 333/202 |
| 5,109,536 A | | 4/1992 | Kommrusch | |
| 5,745,018 A | | 4/1998 | Vangala | |
| 5,864,264 A | * | 1/1999 | Hino | 333/206 |
| 6,081,174 A | * | 6/2000 | Takei et al. | 333/206 |
| 6,404,306 B1 | * | 6/2002 | Kitajima et al. | 333/206 |

FOREIGN PATENT DOCUMENTS

JP 64069102 A * 3/1989

OTHER PUBLICATIONS

U.S. patent application Ser. No. 09/702,420, Hoang et al., filed Oct. 2000.

* cited by examiner

*Primary Examiner*—Seungsook Ham
(74) *Attorney, Agent, or Firm*—Mark P. Bourgeois; Steven Weseman

(57) ABSTRACT

A duplexing filter 10 suitable for use in a mobile communication system. The filter 10 has a core of dielectric material 12 with several through holes 30 that define resonators 25. The core 12 has metallized surfaces 16, 18, 20, 22 and 24 except for the top surface 14. Several metallized resonator pads 60 surround each of the through holes 30 on the top surface 14. A metallized serpentine region 61, 62 extends from one or more of the resonator pads 60 toward a side surface 18 of the core 12. The metallized serpentine region 61, 62 causes attenuation of a third harmonic frequency.

22 Claims, 7 Drawing Sheets

CERAMIC RF FILTER HAVING IMPROVED THIRD HARMONIC RESPONSE

CROSS-REFERENCE TO RELATED APPLICATION

This application claims the benefit of the filing date of U.S. Provisional Patent Application, Ser. No. 60/338,822, filed on Nov. 3, 2001, which is explicitly incorporated by reference, as are all references cited herein.

TECHNICAL FIELD

This invention relates to dielectric block filters for radio-frequency signals, and in particular, to monoblock single pass-band and duplexing filters.

BACKGROUND

Ceramic block filters offer several advantages over lumped component filters. The blocks are relatively easy to manufacture, rugged, and relatively compact. In the basic ceramic block filter design, the resonators are formed by typically cylindrical passages, called holes, extending through the block from the long narrow side to the opposite long narrow side. The block is substantially plated with a conductive material (i.e. metallized) on all but one of its six (outer) sides and on the inside walls formed by the resonator holes.

One of the two opposing sides containing through-hole openings is not fully metallized, but instead bears a metallization pattern designed to couple input and output signals through the series of resonators. This patterned side is conventionally labeled the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1980s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices (e.g. handsets) and longer battery life. Combined, these trends place difficult constraints on the design of wireless components such as filters. Filter designers may not simply add more space-taking resonators or allow greater insertion loss in order to provide improved signal rejection.

A specific challenge in RF filter design is providing sufficient attenuation (or suppression) of signals that are outside the target passband at frequencies which are integer multiples of the frequencies within the passband. The label applied to such integer-multiple frequencies of the passband is a "harmonic." Providing sufficient signal attenuation at the third ($3^{rd}$) harmonic has been a persistent challenge.

Therefore, it would be desirable to provide an RF filter that better attenuates $3^{rd}$ harmonic frequencies without sacrificing other performance parameters such as size, passband insertion loss and material costs.

SUMMARY

This invention overcomes problems of the prior art by providing a ceramic block RF filter having improved $3^{rd}$ harmonic rejection in a small size. A duplexing communication signal filter for connection to an antenna, a transmitter and a receiver for filtering an incoming signal from the antenna to the receiver are provided. The filter also modulates an outgoing signal from the transmitter to the antenna. The filter includes a core of dielectric material having a top and bottom surface and four side surfaces having vertical edges. Several through holes extend from the top to the bottom surface. Each of the through holes defines a resonator. A contiguous unmetallized area is located on the top surface and extends to one of the side surfaces. A first metallization area is located on the bottom surface, the side surfaces and on the inner surfaces of the through holes. A transmitter electrode, an antenna electrode and a receiver electrode are located on the top surface and extend to one of the side surfaces. Several metallized resonator pads are adjacent to each of the through holes on the top surface. The resonator pads are connected to the first metallization area. A metallized serpentine region extends from at least one of the resonator pads toward one of the side surfaces. The metallized serpentine region is adapted to cause attenuation of a third harmonic frequency.

An embodiment of the present invention can be specified as a duplexing communication signal filter adapted for connection to an antenna, a transmitter and a receiver for filtering an incoming signal from the antenna to the receiver and for filtering an outgoing signal from the transmitter to the antenna. The duplexing filter comprises a rigid core of dielectric material with top, bottom and at least four side surfaces and a surface-layer pattern of metallized and unmetallized areas on the core.

The rigid core of dielectric material defines a series of through-holes, each extending from an opening on the core top surface to an opening on the core bottom surface. The surface-layer pattern of metallized and unmetallized areas includes a wide area of metallization for providing off-band signal absorption, a pad of metallization adjacent to at least one of the through-hole openings on the top surface (i.e. a resonator pad), a contiguous unmetallized area substantially surrounding the resonator pad, a transmitter connection area of metallization, a receiver connection area of metallization spaced apart from the transmitter connection area, and an antenna connection area of metallization positioned between the transmitter connection area and the receiver connection area. The resonator pad has a narrow intricate extension. The intricate extension preferably has a sinuous path.

In an alternate embodiment of the present invention a signal filter having input and output electrodes is provided. Specifically the filter comprises a rigid core of dielectric material, preferably with a rectangular parallelepiped shape, and a surface-layer pattern of metallized and unmetallized areas supported by the core. The core has a top surface, bottom surface and at least four side surfaces. The core defines a series of through-holes, each extending from an opening on the top surface to an opening on the bottom surface. The surface-layer pattern of metallized and unmetallized areas includes a wide area of metallization to absorb off-band signals, a pad of metallization adjacent at least one of the through-hole openings on the top surface. The pad has a narrow sinuous extension. The surface-layer pattern also includes a contiguous unmetallized area substantially surrounding the pad, an input connection area of metallization and an output connection area of metallization spaced apart from the input connection area.

There are other advantages and features of this invention which will be more readily apparent from the following detailed description of preferred embodiments of the invention, the drawings, and the appended claims.

BRIEF DESCRIPTION OF THE FIGURES

In the Figures.

The Figures are not drawn to scale.

DETAILED DESCRIPTION OF PREFERRED EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
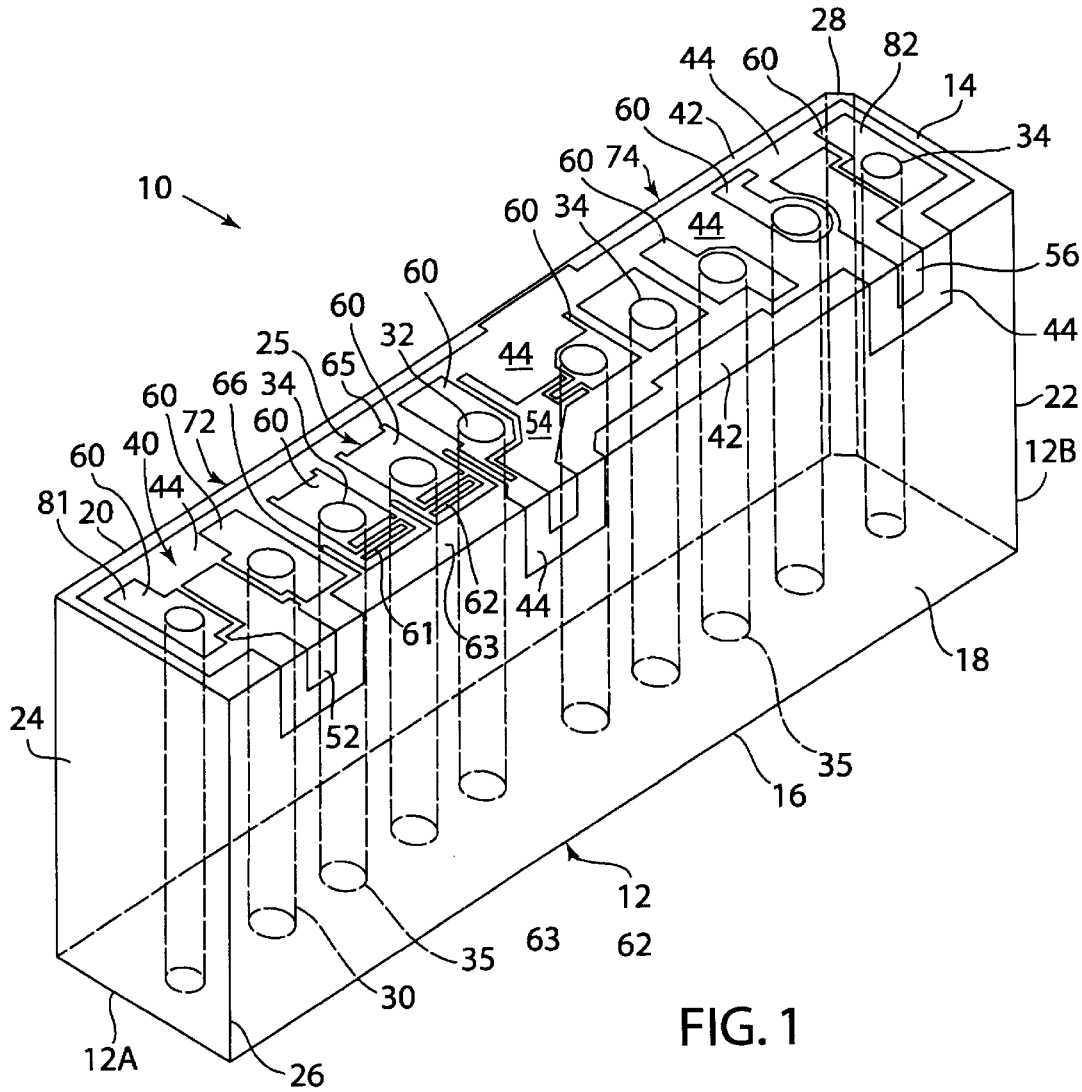
FIG. 1 is an enlarged perspective (or more precisely an isometric) view of a duplexing filter according to the present invention with the shield removed to reveal details of the surface-layer pattern of metallized and unmetallized areas.
Figure 2:
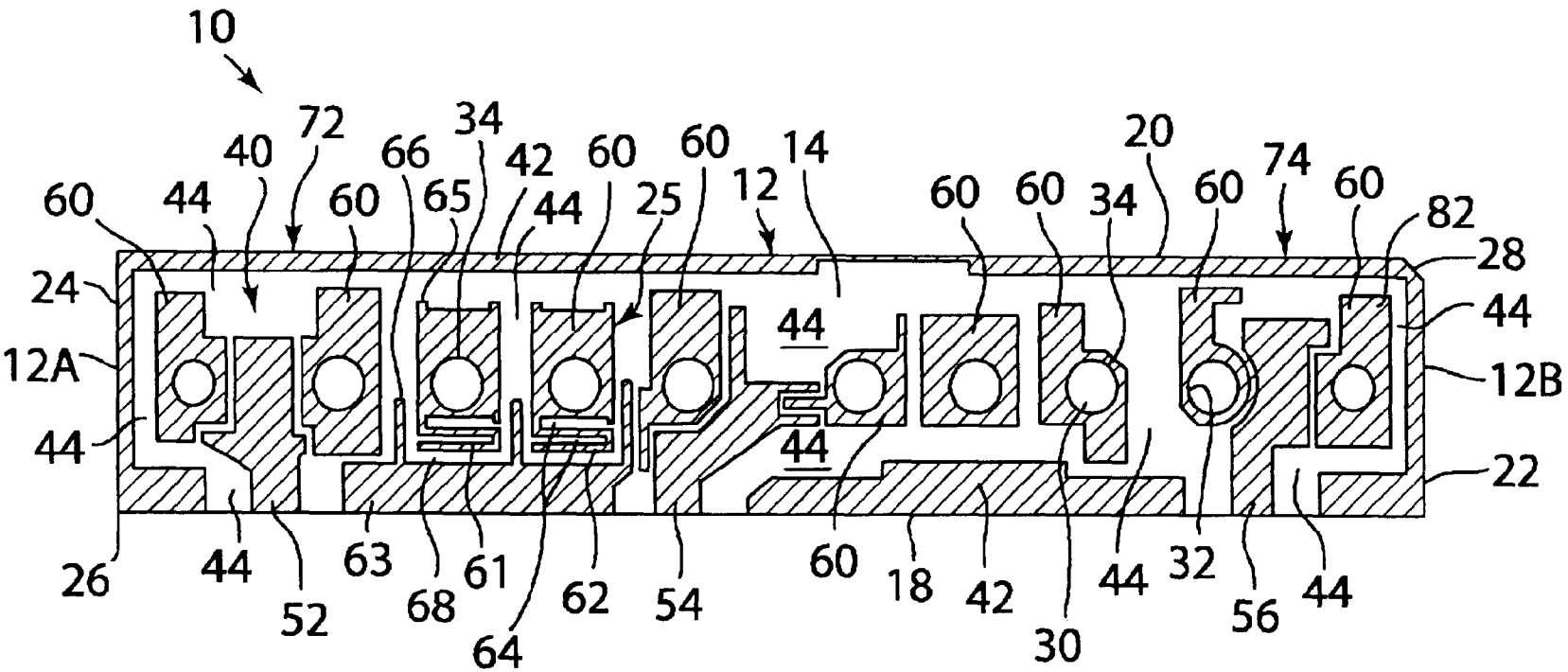
FIG. 2 is an enlarged view of the top surface of the duplexer of FIG. 1.

Referring to FIGS. 1 and 2, an antenna duplexer or RF filter 10 comprises an elongate, parallelepiped or box-shaped rigid core of ceramic dielectric material 12. The dielectric material is preferably barium or neodymium ceramic. Preferred dielectric materials for the rigid core 12 have a dielectric constant of about 37 or above. Core 12 has ends 12A and 12B. Core 12 has an outer surface with six sides, a top 14, a bottom 16, a first side 18, an opposite second side 20, third side 22 and an opposite fourth side 24. Multiple vertical edges 26 are defined by adjacent sides of core 12. A bevel 28 is preferably present on core 12 for orienting the filter during manufacturing and assembly.

The filter has a plurality of resonators 25 based on metallized through-holes. Specifically, the resonators take the form of through-holes 30 defined in dielectric core 12 with metallized side walls. Through holes 30 extend from openings 34 in top surface 14 to openings 35 in bottom surface 16. The through holes have an inner side-wall surface 32.

Core 12 has a surface-layer pattern 40 of metallized and unmetallized areas. The metallized areas are preferably a surface layer of conductive silver-containing material. Pattern 40 includes a wide area of metallization 42 that covers the bottom surface 16, and side surfaces 20, 22 and 24. Wide area of metallization 42 also covers a portion of top surface 14 and side surface 18 and side walls 32 of through holes 30. Metallized area 42 extends contiguously from within resonator holes 30 towards both top surface 14 and bottom surface 18. Metallization area 42 may also be labeled a ground electrode. Area 42 serves to absorb or prevent transmission of off-band signals.

In a preferred embodiment, the more detailed aspects of pattern 40 are present on top surface 14. For example, a portion of metallized area 42 is present in the form of resonator pads 60 which are adjacent each opening 34. Resonator pads 60 are contiguous or connected with metallization area 42 that extends from inner surface 32 of through holes 30. Resonator pads 60 at least partially surround openings 34 of through-holes 30. Resonator pads 60 are shaped to have predetermined capacitive couplings to adjacent resonators and other areas of surface-layer metallization.

A contiguous unmetallized area 44 extends over portions of top surface 14 and portions of side surface 18. Unmetallized area 44 surrounds at least one, and preferably all, of the metallized resonator pads 60. Two of the resonator pads 60 each include an intricate extension (61 or 62) that extends toward side surface 18. Intricate extension (61 or 62) preferably has a sinuous shape, a C-shape or a serpentine shape. Intricate extensions 61 or 62 could also be labeled a metallized serpentine region.

Metallized serpentine region (61 or 62) extends toward a top surface portion 63 of metallization area 42 which is adjacent side 18. Unmetallized area 44 extends around serpentine region 62 as shown by reference numeral 64. Unmetallized area 44 also includes a gap 68 separating region 62 from portion 63. Metallization area 42 also includes a finger portion 66 extending from portion 63 towards side 20 and between adjacent resonators 66 (FIG. 2). Some of the resonator pads 60, which are also part of area 42, include tabs 65 extending toward side 20.

The surface pattern 40 includes metallized areas and unmetallized areas. The metallized areas are spaced apart from one another and are therefore capacitively coupled. The amount of capacitive coupling is roughly related to the size of the metallization areas and the separation distance between adjacent metallized portions as well as the overall core configuration and the dielectric constant of the core dielectric material. Similarly, surface pattern 40 also creates inductive coupling between the metallized areas. Metallized serpentine region 62 causes a series resonant circuit to be formed between the resonator pad 60 and the wide area of metallization 42.

The series resonant circuit includes a capacitance and an inductance in series connected to ground. The shape of the serpentine metallized region, unmetallized slots 64 and gap 68, metallized area 63 and metallized fingers 66 determines the overall capacitance and inductance values. The capacitance and inductance values are designed to form the series resonant circuit to be resonant at a third harmonic frequency that is desired to be filtered. The metallized serpentine region 62 causes attenuation of the third harmonic frequency. Serpentine region 62 can be added to additional resonator pads 60 to improve the attenuation.

Surface-layer pattern 40 includes three isolated metallized areas for connection to transceiver components: a transmitter connection area 52, an antenna connection area 54, and a receiver connection area 56. Connection areas 52, 54 and 56 are conventionally called electrodes. These electrodes extend onto side surface 18 where they can serve as surface mounting connection points. Note that contiguous unmetallized area 44 preferably surrounds each connection area (or electrode) 52, 54 and 56.

For ease of description, duplexer filter 10 can be divided approximately at antenna electrode 54 into two branches of resonators 25, a transmitter branch 72 and a receiver branch 74. Transmitter branch 72 extends between antenna electrode 54 and end 12A, while receiver branch 74 extends between antenna electrode 54 and end 12B. Each branch includes a plurality of resonators 25 and a respective input/output electrode. More specifically, transmitter branch 72 includes a transmitter electrode 52, and receiver branch 74 includes a receiver electrode 56. Transmitter electrode 52 and receiver electrode 56 are spaced apart from antenna electrode 54 in opposite directions along the length of core 12.

Filter 10 includes two signal trap resonators 81 and 82. A transmit trap resonator 81 is located adjacent transmitter electrode 52 but opposite the array of spaced-apart resonators 25 of transmit branch 72 such that trap resonator 81 is positioned between transmitter electrode 52 and end 12A. A trap resonator 82 is located adjacent receive electrode 56 but opposite the array of spaced-apart resonators 25 of receive branch 74 such that trap resonator 82 is positioned between receive electrode 56 and second end 23B.

The surface-layer pattern of metallized and unmetallized areas 40 on core 12 is prepared by providing a rigid core of dielectric material including through-holes to predetermined dimensions. The outer surfaces and through-hole side walls are coated with a metal layer, preferably including silver, by spraying, plating or dipping. The preferred method of coating the dielectric core varies according to the number of cores to be coated. After coating, the surface-layer pattern 40 is preferably created by laser ablation of the metal over areas designated to be unmetallized. This laser ablation approach results in unmetallized areas recessed into the surfaces of core 12 because laser ablation removes both the metal layer and a slight portion of the dielectric material.

Filters according to the present invention are preferably equipped with a metallic shield positioned across top surface 14. For a discussion of metal shield configurations, see U.S. Pat. No. 5,745,018 to Vangala, the relevant disclosure of which is incorporated herein by reference.

Dielectric block filters of this invention have several advantages. One key feature of this invention is the ability to block $3^{rd}$ harmonic frequencies. This results in less noise being present in a communication system. A second key feature is a robust design approach for manufacturing. Because the filter response can be changed by altering the pattern on the top surface, no re-tooling of the core is required.

EXAMPLE 1

A batch of duplexer filters according to the present invention and shown in FIGS. 1 and 2 was prepared. Specifically, the filters were prepared with a top surface pattern of metallization as shown in FIG. 2. Fabrication details are specified in Table 1, below.

TABLE 1

| | | |
|---|---|---|
| Resonators | 10 | |
| Length | 24 | millimeters (mm) |
| Height (shieldless) | 5.3 | millimeters (mm) |
| Width | 4.6 | millimeters (mm) |
| Through-hole Diameter | 0.9 | millimeters (mm) |
| Dielectric Constant | 37.5 | |
| Resonator pad width | 1.5 | millimeters (mm) |
| Resonator pad length | 2.2 | millimeters (mm) |
| Intricate Extension (track/path width) | 0.13 | millimeters (mm) |
| Intricate Extension (track/path width) | 3.4 | millimeters (mm) |

The prepared filters were evaluated with S21 measurements on a Hewlett Packard network analyzer. The prepared example filters were evaluated with top shields present. Filter performance parameters are listed in TABLE 2, below.

TABLE 2

| | | |
|---|---|---|
| Transmit Band | 1850–1910 | Megahertz (MHz). |
| Transmit Band Insertion Loss | 2.6 | dB (at about 1910 MHz) |
| Third ($3^{rd}$) harmonic suppression Of Transmit Band | 22 | dB |
| Receive Band | 1930–1990 | Megahertz (MHz). |
| Receive Band Insertion Loss | 3.0 | dB (at about 1930 MHz) |

COMPARISON EXAMPLE

Figure 3:
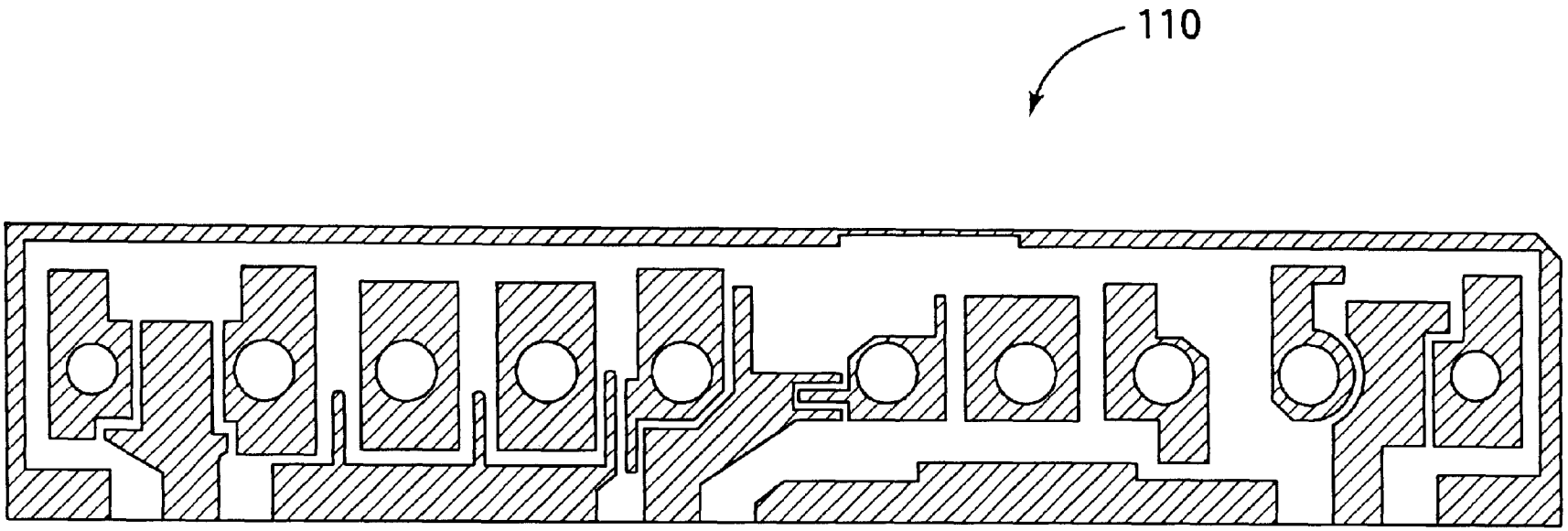
FIG. 3 is an enlarged view of a top print pattern of a duplexer lacking the resonator pad intricate extension.

FIG. 3 is an enlarged top surface view of a duplexer filter 110 provided for performance comparison. Filter 110 lacked the intricate extension/serpentine region 62 of filter 10 (FIG. 2) but otherwise had similar dimensions and signal passbands.

Figure 4:
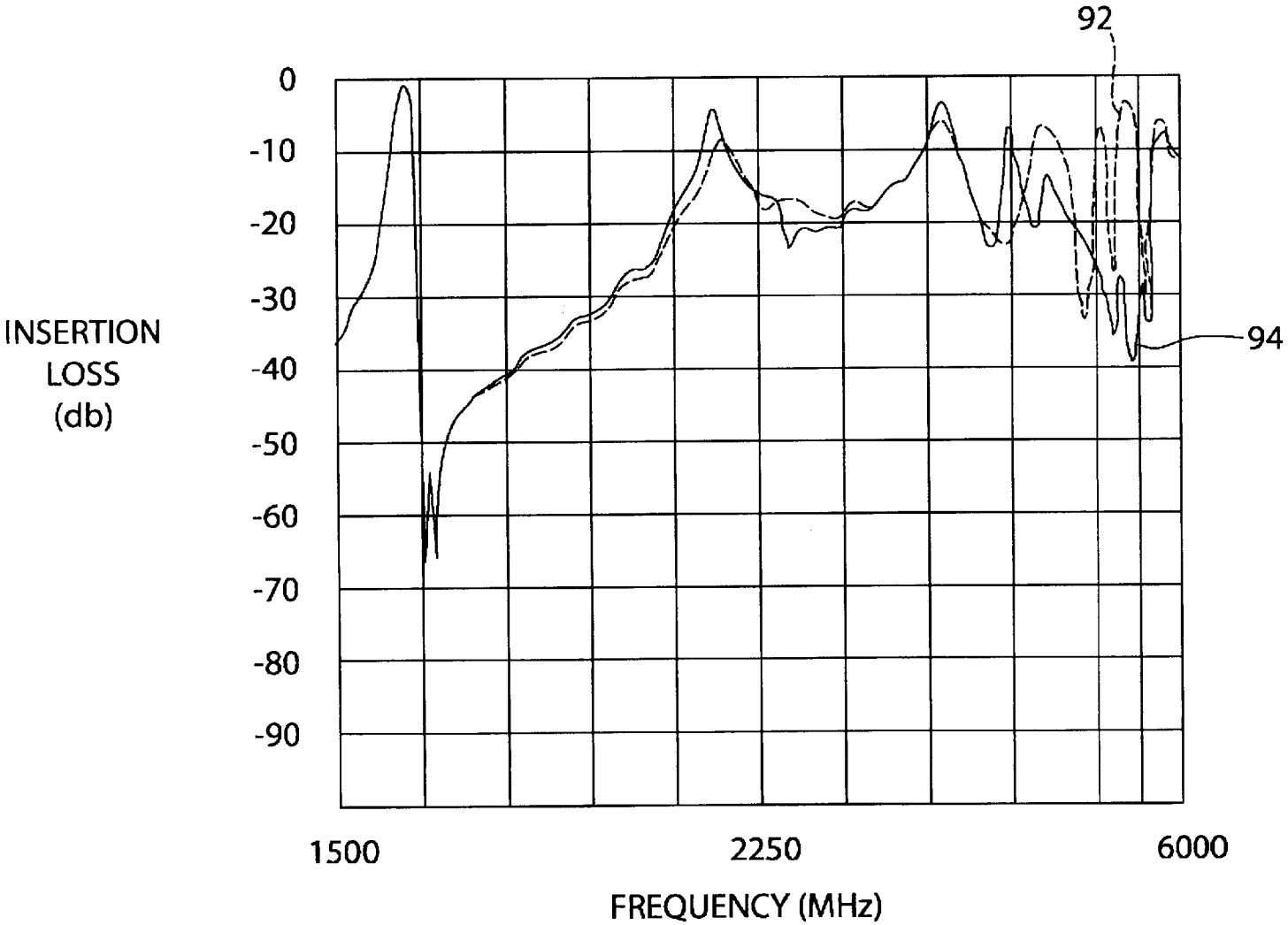
FIG. 4 is a frequency response graph for the duplexer shown in FIG. 1.

FIG. 4 is a graph of signal strength (or loss) versus frequency demonstrating the specific measured performance of the Example 1 duplexer and comparison duplexer filter 110. Waveform 92 shows the performance of filter 110, which lacks serpentine region 62. Waveform 94 shows the performance of the Example 1 filters which have a serpentine region 62.

At a transmit frequency of 1910 MHz, a third harmonic frequency is generated at approximately 5730 MHz. The serpentine region 62 is able to increase attenuation at third harmonic frequencies by approximately 20 db. It is also noted that the performance of the filter is not degraded in the passband or the stopband of the filter. All measurements were S21 measurements carried out on a Hewlett Packard network analyzer.

Although the graph in FIG. 4 showed exemplary applications in the range of 1 to 6 Giga-Hertz, an application of the present invention to frequencies in the greater of 0.5 to 20 Giga-Hertz is contemplated. The present invention can be applied to an RF signal filter operating at a variety of frequencies. Suitable applications include, but are not limited to, cellular telephones, cellular telephone base stations, and subscriber units. Other possible higher frequency applications include other telecommunication devices such as satellite communications, Global Positioning Satellites (GPS), or other microwave applications.

EXAMPLE 2

A batch of duplexer filters were prepared according to an alternate embodiment of the present invention. Perspective view FIG. 5 and enlarged top print view FIG. 6 reveal design details for duplexer filter 200. Fabrication and performance details are specified in Table 3, below.

TABLE 3

| | | |
|---|---|---|
| Resonators | 9 | |
| Length | 19.8 | millimeters (mm) |
| Height (shieldless) | 5.3 | millimeters (mm) |
| Width | 4.6 | millimeters (mm) |
| Dielectric Constant | 37.5 | |
| Transmit Band | 1850–1910 | Megahertz (MHz). |
| Transmit Band Insertion Loss | 2.6 | dB (at about 1910 MHz) |
| Third (3rd) harmonic suppression Of Transmit Band | 20 | dB |
| Receive Band | 1930–1990 | Megahertz (MHz). |
| Receive Band Insertion Loss | 3.0 | dB (at about 1930 MHz) |

Figure 5:
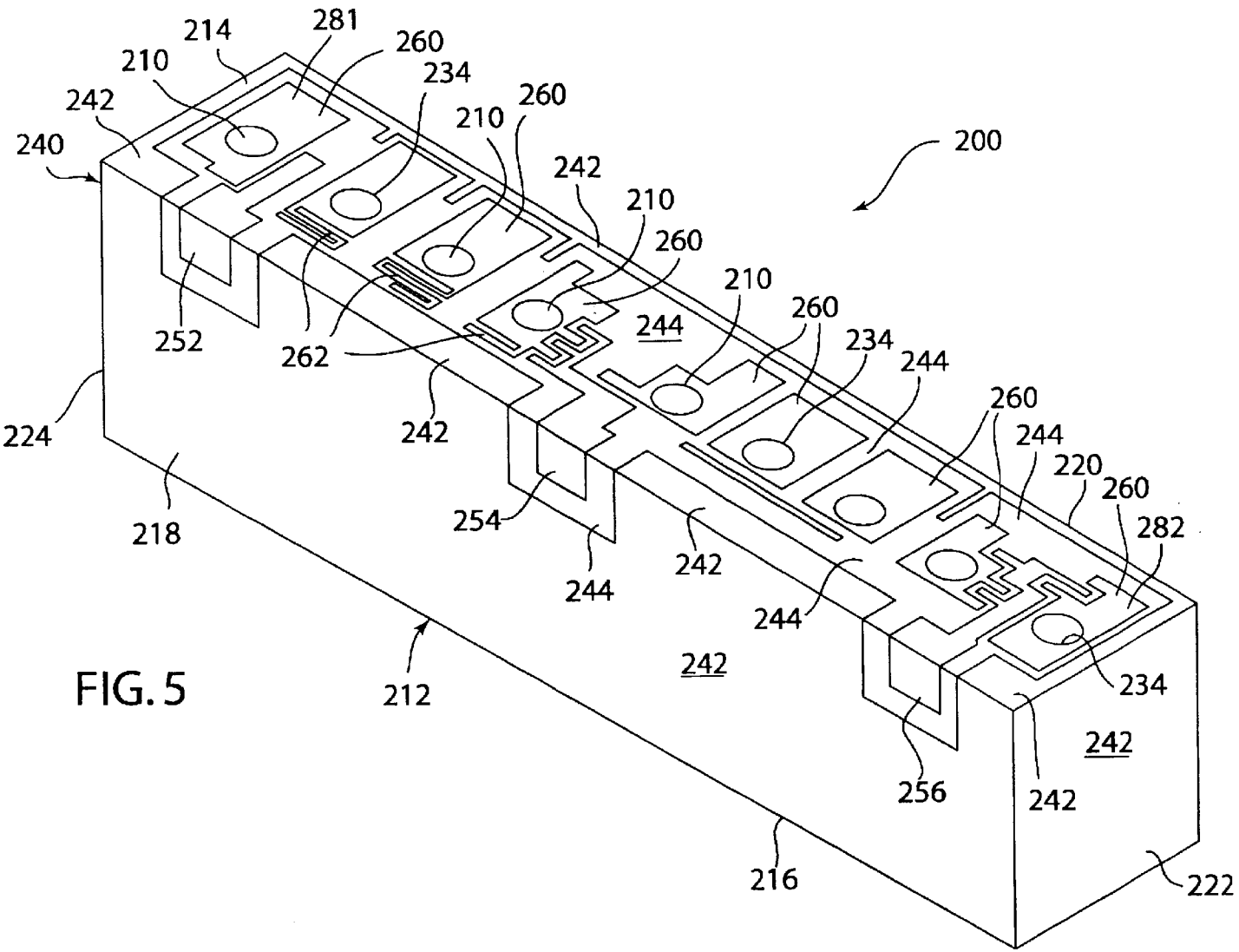
FIG. 5 is a perspective view of a duplexer according to an alternate embodiment of the present invention with the shield removed to reveal details of the surface-layer pattern of metallized and unmetallized areas.
Figure 6:
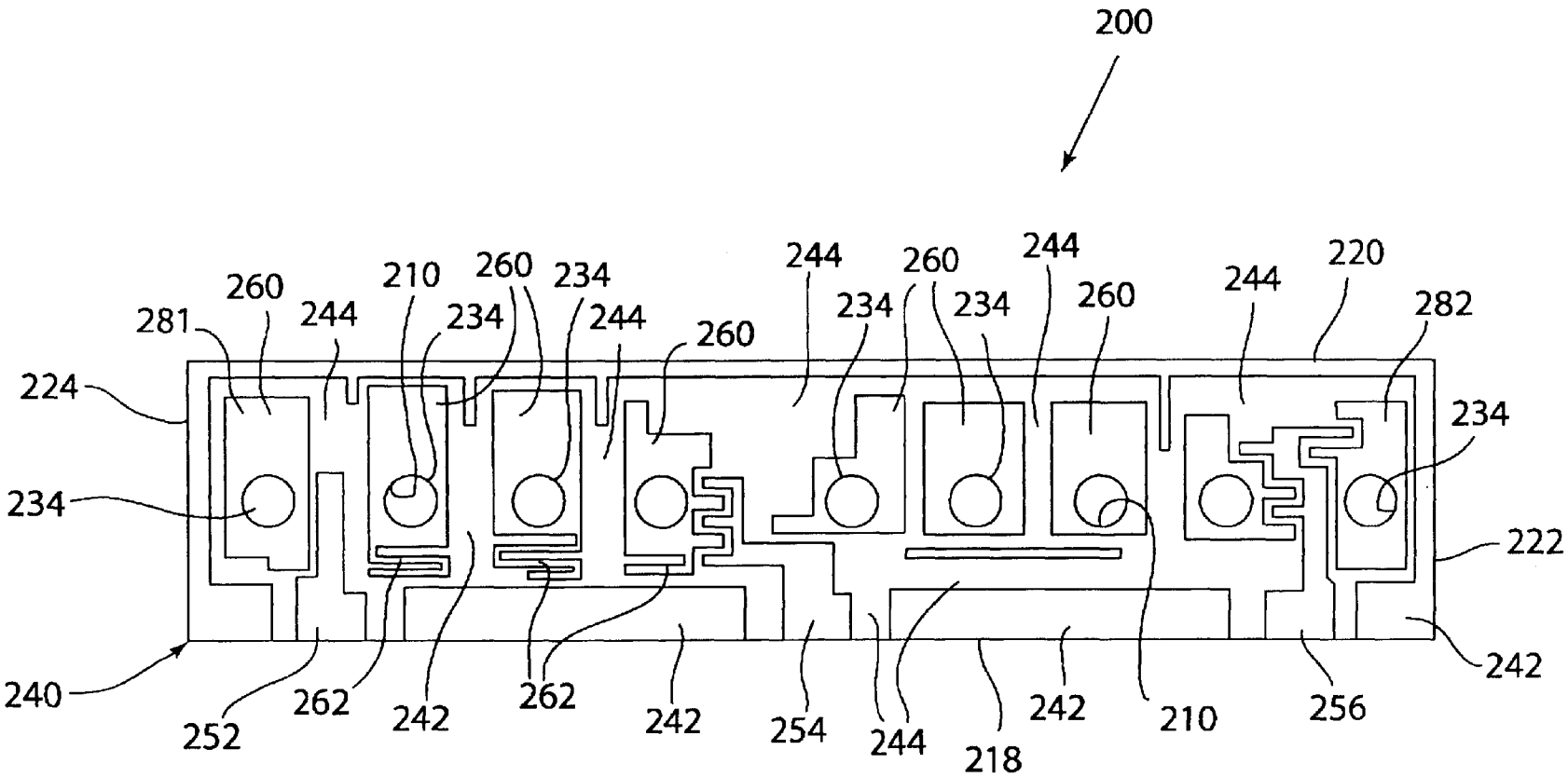
FIG. 6 is a view of the top surface of the duplexer of FIG. 5.

Referring to FIGS. 5 and 6, a relatively shorter duplexer 200 is adapted for connection to an antenna, a transmitter and a receiver for filtering an incoming signal from the antenna to the receiver and for filtering an outgoing signal from the transmitter to the antenna. Filter 200 comprises a rigid core of dielectric 212 material with a top surface 214, a bottom surface 216 and at least four side surfaces 218, 220, 222 and 224. Rigid core 212 defines a series of through-holes 210. Each through-hole 210 extends from an opening 234 on top surface 214 to an opening (not separately shown) on bottom surface 216. Core 212 supports a surface-layer pattern of metallized and unmetallized areas 240. Pattern 240 includes a wide area of metallization 242 for providing off-band signal absorption, a pad of metallization 260 adjacent at least one of the through-hole openings 234 on top surface 214. Pattern 240 also includes a contiguous unmetallized area 244 substantially surrounding pad 260, a transmitter connection area of metallization 252, a receiver connection area of metallization 256 spaced apart from transmitter connection area 252, and an antenna connection area of metallization 254 positioned between transmitter connection area 252 and receiver connection area 256. Pad 260 has a narrow intricate extension 262 that is preferably sinuous as shown.

Filter 200 preferably includes a transmit branch trap resonator 281 and a receive branch trap resonator 282.

Notably, example filter 200 has one less resonator (9 resonators versus the 10 resonators of filter 10) and a reduced length. Filters 200 included three resonators with intricate extensions 262. The prepared filters 200 were evaluated with too surface shields present.

Alternate Embodiment

Figure 7:
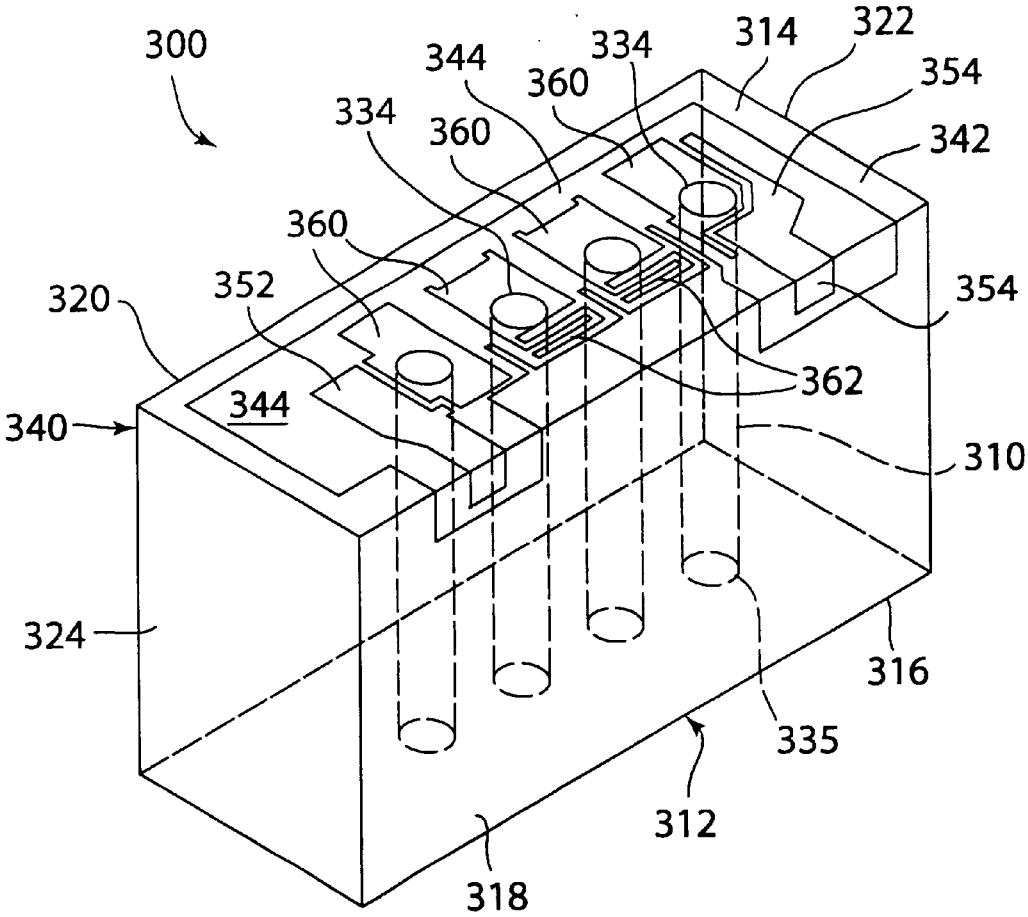
FIG. 7 is a perspective view of a band-pass filter according to an alternate embodiment of the present invention.
Figure 8:
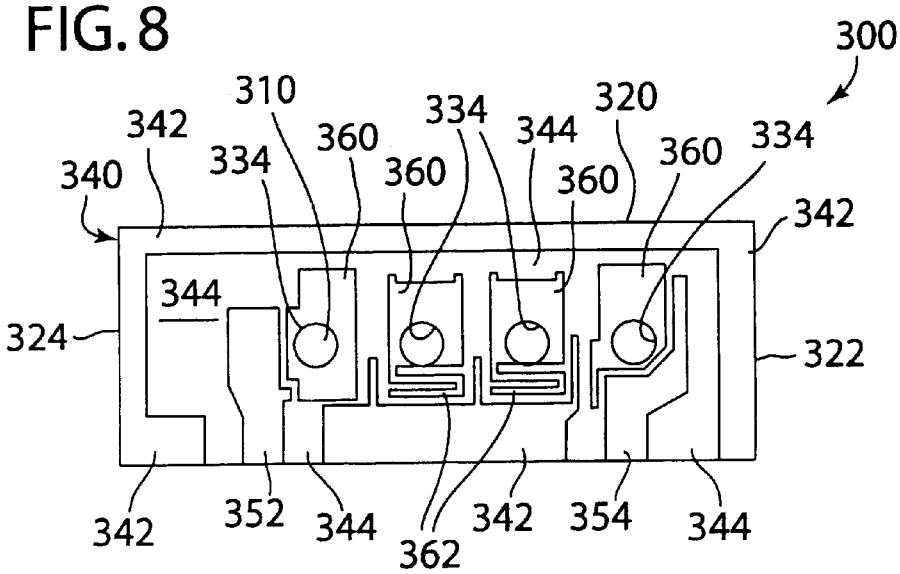
FIG. 8 is a view of the top surface of the duplexer of FIG. 7.

FIGS. 7 and 8 depict an alternate embodiment of the present invention, passband filter 310 which is configured to have a single passband. Specifically, filter 310 includes a rigid core of dielectric material 312 with a top surface 314, a bottom surface 316 and at least four side surfaces 318, 320, 322 and 324. Core 312 defines a series of through-holes 310. Each through-hole extends from an opening 334 on top surface 314 to an opening 335 on bottom surface 316.

A surface-layer pattern of metallized and unmetallized areas 340 is supported by core 312. Pattern 340 includes a wide area of metallization 342 for providing off-band signal absorption and a pad of metallization 360 adjacent at least one of the through-hole openings 334 on top surface 314. Pad 360 includes a narrow sinuous extension 362 extending towards side surface 318. A contiguous unmetallized area 344 substantially surrounds the pad 360. Pattern 340 also includes an input connection area 352 of metallization and an output connection area 354 of metallization spaced apart from input connection area 352. Filter 310 includes sinuous intricate extensions 362 from two resonator pads 360.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

We claim:

1. A signal filter suitable for use in a mobile communication device, the filter comprising:

a core of dielectric material having a top, a bottom and four side surfaces having vertical edges;

a plurality of through holes extending from the top to the bottom surface, each through hole defining a resonator;

a contiguous unmetallized area located on the top surface and extending to one of the side surfaces;

a first metallized area located on the bottom surface, the side surfaces and on the inner surfaces of the through holes;

a transmitter electrode, an antenna electrode and a receiver electrode, each located on the top surface and extending to one of the side surfaces;

a plurality of metallized resonator pads adjacent each of the through holes on the top surface, the resonator pads being connected to the first metallized area at the inner surfaces of the through holes; and a metallized serpentine region extending from at least one of the resonator pads towards one of the side surfaces adapted to cause attenuation of a third harmonic frequency.

2. A signal filter suitable for use in a mobile communication device, the filter comprising:

a core of dielectric material having a top, a bottom and four side surfaces having vertical edges;

a plurality of through holes extending from the top to the bottom surface, each through hole defining a resonator;

a contiguous unmetallized area located on the top surface and extending to one of the side surfaces;

a first metallized area located on the bottom surface, the side surfaces and on the inner surfaces of the through holes;

a transmitter electrode, an antenna electrode and a receiver electrode, each located on the top surface and extending to one of the side surfaces;

a plurality of metallized resonator pads adjacent each of the through holes on the top surface, the resonator pads being connected to the first metallized area; and a metallized serpentine region extending from at least one of the resonator pads towards one of the side surfaces wherein the serpentine region forms a series resonant circuit to ground that attenuates the third harmonic frequency.

3. The filter of claim 2 wherein the serpentine region is located between the transmitter electrode and the antenna electrode.

4. A duplexing communication signal filter adapted for connection to an antenna, a transmitter and a receiver for filtering an incoming signal from said antenna to said receiver and for filtering an outgoing signal from said transmitter to said antenna, the filter comprising:

a rigid core of dielectric material with a top surface, a bottom surface and at least four side surfaces, said core defining a series of through holes, each through hole extending from an opening on said top surface to an opening on said bottom surface;

a surface-layer pattern of metallized and unmetallized areas on said core, the pattern including:

a wide area of metallization, a pad of metallization adjacent at least one of said through hole openings on said top surface and connected to said wide area of metallization at said through hole opening, a contiguous unmetallized area substantially surrounding said pad;

a transmitter connection area of metallization, a receiver connection area of metallization spaced apart from said transmitter connection area, an antenna connection area of metallization positioned between said transmitter connection area and said receiver connection area, said pad having a narrow sinuous extension adapted to cause attenuation of a third harmonic frequency.

5. The duplexing communication filter according to claim 4 wherein said rigid core has a substantially rectangular parallelepiped shape.

6. The duplexing communication filter according to claim 4 wherein said each one of said series of through-holes has side walls and said wide area of metallization is present on said bottom surface, each said side surface and said side walls of each said through-hole.

7. The duplexing communication filter according to claim 4 wherein each one of said series of through-holes has side walls and said wide area of metallization contiguously extends over said side walls of each said one of said series of through holes, said bottom surface, said side surfaces and selected portions of said top surface.

8. The duplexing communication filter according to claim 4 wherein at least one of said series of through holes is positioned between a side surface of said core and said transmitter connection area to serve as a signal trap resonator.

9. The duplexing communication filter according to claim 4 wherein at least one of said series of through holes is positioned between a side surface of said core and said receiver connection area to serve as a signal trap resonator.

10. The duplexing filter according to claim 4 wherein said contiguous unmetallized area substantially surrounds said pad, said transmitter connection area, said receiver connection area and said transmitter connection area.

11. The duplexing filter according to claim 4 wherein said transmitter connection area extends over portions of said top surface and one of said side surfaces.

12. The duplexing filter according to claim 4 wherein said top surface has a metallization pattern as shown in FIG. 2.

13. The duplexing filter according to claim 4 wherein said series of through holes includes ten through holes.

14. The duplexing filter according to claim 4 exhibiting a filtering passband for said outgoing signal from about 1850 to about 1910 Megahertz (MHz).

15. The duplexing filter according to claim 4 exhibiting a filtering passband for said incoming signal from about 1930 to about 1990 Megahertz (MHz).

16. The duplexing filter according to claim 4 having a length of at most about 24 millimeters and exhibiting a filtering passband for said outgoing signal from about 1850 to about 1910 Megahertz (MHz) and a maximum insertion loss over said passband of at most about 2.6 dB.

17. The duplexing filter according to claim 4 wherein said surface-layer pattern includes an unmetallized area created by laser ablation of a fully metallized core of dielectric material.

18. The duplexing filter according to claim 4 wherein said surface-layer pattern includes an unmetallized area recessed from said top surface of said block.

19. The duplexing filter according to claim 4 wherein said top surface has a metallization pattern as shown in FIG. 6.

20. A signal filter comprising:

a rigid core of dielectric material with a top surface, a bottom surface and at least four side surfaces, said core defining a series of through holes, each through hole extending from an opening on said top surface to an opening on said bottom surface;

a surface-layer pattern of metallized and unmetallized areas on said core, the pattern including:

a wide area of metallization for providing off-band signal absorption, a pad of metallization adjacent at least one of said through hole openings on said top surface, the pad being connected to said wide area of metallization at said through hole opening and having a narrow sinuous extension adapted to cause attenuation of a third harmonic frequency, a contiguous unmetallized area substantially surrounding said pad, an input connection area of metallization, an output connection area of metallization spaced apart from said input connection area.

21. A duplexing communication signal filter adapted for connection to an antenna, a transmitter and a receiver for faltering an incoming signal from said antenna to said receiver and for filtering an outgoing signal from said transmitter to said antenna, the filter comprising:

a rigid core of dielectric material with a top surface, a bottom surface and at least four side surfaces, said core defining a series of through holes, each through hole extending from an opening on said top surface to an opening on said bottom surface;

a surface-layer pattern of metallized and unmetallized areas on said core, the pattern including:

a wide area of metallization, a pad of metallization adjacent at least one of said through hole openings on said top surface and connected to said wide area of metallization at said through hole opening, a contiguous unmetallized area substantially surrounding said pad;

a transmitter connection area of metallization, a receiver connection area of metallization spaced apart from said transmitter connection area, an antenna connection area of metallization positioned between said transmitter connection area and said receiver connection area, said pad including an extension having a sinuous path and forming a series resonant circuit to ground that attenuates the third harmonic frequency.

22. A duplexing communication signal filter adapted for connection to an antenna, a transmitter and a receiver for filtering an incoming signal from said antenna to said receiver and for filtering an outgoing signal from said transmitter to said antenna, the filter comprising:

a rigid core of dielectric material with a top surface, a bottom surface and at least four side surfaces, said core defining a series of through holes, each through hole extending from an opening on said top surface to an opening on said bottom surface;

a surface-layer pattern of metallized and unmetallized areas on said core, the pattern including:

a wide area of metallization, a pad of metallization adjacent at least one of said through hole openings on said top surface and connected to said wide area of metallization at said through hole opening, a contiguous unmetallized area substantially surrounding said pad;

a transmitter connection area of metallization, a receiver connection area of metallization spaced apart from said transmitter connection area, an antenna connection area of metallization positioned between said transmitter connection area and said receiver connection area, said pad including an intricate extension having a serpentine shape adapted to cause attenuation of a third harmonic frequency.

* * * * *